US005992055A

United States Patent [19]

Connor

[11] Patent Number: 5,992,055

[45] **Date of Patent: *Nov. 30, 1999**

[54] INSOLES, LINERS AND FOOTWEAR INCORPORATING SISAL MATERIAL

[76] Inventor: Dennis J. Connor, 4 Milligan Pl., #3F, New York, N.Y. 10011

[ * ] Notice: This patent is subject to a terminal disclaimer.

[21] Appl. No.: 09/296,463

[22] Filed: Apr. 22, 1999

Related U.S. Application Data

[63] Continuation of application No. 08/664,387, Jun. 14, 1996, Pat. No. 5,930,916.

[51] Int. Cl.[6] ..... A43B 13/38

[52] U.S. Cl. ..... 36/43; 36/88; 36/11.5

[58] Field of Search ..... 36/43, 44, 88, 36/140, 141, 11.5, 9 R

[56] References Cited

U.S. PATENT DOCUMENTS

| | | |
|---|---|---|
| 3,468,040 | 9/1969 | Fukuoka . |
| 3,724,106 | 4/1973 | Magidson . |
| 3,859,727 | 1/1975 | Nakamoto . |
| 3,922,801 | 12/1975 | Zente . |
| 4,079,526 | 3/1978 | Fukuoka . |
| 4,094,081 | 6/1978 | Reiner et al. . |
| 4,095,355 | 6/1978 | Annovi . |
| 4,170,078 | 10/1979 | Moss . |
| 4,316,332 | 2/1982 | Giese . |
| 4,316,333 | 2/1982 | Rothschild et al. . |
| 4,316,334 | 2/1982 | Hunt . |
| 4,567,677 | 2/1986 | Zona . |
| 4,603,493 | 8/1986 | Eston . |
| 4,642,912 | 2/1987 | Wildman et al. . |
| 4,642,913 | 2/1987 | Hase et al. . |
| 4,642,914 | 2/1987 | Caldeira . |
| 4,694,589 | 9/1987 | Sullivan et al. . |
| 4,694,831 | 9/1987 | Seltzer . |
| 4,697,361 | 10/1987 | Ganter et al. . |
| 4,709,921 | 12/1987 | Valuikas et al. . |
| 5,195,257 | 3/1993 | Holcomb et al. . |

*Primary Examiner*—M. D. Patterson
*Attorney, Agent, or Firm*—Antonelli, Terry, Stout & Kraus, LLP

[57] ABSTRACT

Footwear products incorporating the use of natural materials; therein, and, more particularly, insoles, liners, and footwear incorporating sisal material. The sisal material is arranged so as to provide direct contact with a user foot in order to avail to the user foot the sisal therapeutic benefits of skin massaging, exfoliation of the skin, increased blood flow and ventilation, and the wearability benefits of a non-slip surface and evacuation of foreign objects from direct contact from a user foot. The insoles are at least partially formed of sisal material and can be provided in a flat or contoured form. As another embodiment, the sisal insole is provided as part of a sisal sandal arrangement which incorporates sandal straps and sandals fasteners for attachment to a user foot in a sandal arrangement. An additional embodiment is directed to the form a sisal liner which can be permanently or removably insertable into footwear so as to afford an arrangement providing a lining of sisal material within at least a portion of a cavity of a footwear.

20 Claims, 5 Drawing Sheets

INSOLES, LINERS AND FOOTWEAR INCORPORATING SISAL MATERIAL

CROSS-REFERENCE TO RELATED APPLICATION

This application is a continuation of application Ser. No. 08/664,387, filed Jun. 14, 1996, U.S. Pat. No. 5,930,916.

BACKGROUND OF THE INVENTION

1. Field of the Invention

The subject invention relates in general to insoles, liners and footwear, and more particularly, to insoles, liners and footwear incorporating loofah material.

2. Description of Related Art

An array of available footwear products has broadened and increased in popularity in recent years. Further, use of natural material in consumer products has gained in frequency in recent years.

The following represents a listing of known related art pertaining to feet, footwear products and/or natural materials:

U.S. Pat. No. 4,694,589 issued to Sullivan et al. on Sep. 22, 1987;

U.S. Pat. No. 3,468,040 issued to Tatuo Fukuoka on Sep. 23, 1969;

U.S. Pat. No. 4,567,677 issued to James Zona on Feb. 4, 1986;

U.S. Pat. No. 4,694,831 issued to Charles J. Seltzer on Sep. 22, 1987;

U.S. Pat. No. 4,603,493 issued to Gary A. Eston on Aug. 5, 1986;

U.S. Pat. No. 4,170,078 issued to Ronald Moss on Oct. 9, 1979;

U.S. Pat. No. 4,316,332 issued to Giese et al. on Feb 23, 1982;

U.S. Pat. No. 4,316,333 issued to Rothschild et al. on Feb. 23, 1982;

U.S. Pat. No. 4,316,334 issued to Helen M. Hunt on Feb. 23, 1982;

U.S. Pat. No. 4,642,912 issued to Wildman et al. on Feb. 17, 1987;

U.S. Pat. No. 4,642,913 issued to Hase et al. on Feb. 17, 1987;

U.S. Pat. No. 4,642,914 issued to Adelino Caldeira on Feb. 17, 1987;

U.S. Pat. No. 4,697,361 issued to Ganter et al. on Oct. 6, 1987;

U.S. Pat. No. 3,724,106 issued to Herbert Magidson on Apr. 3, 1973;

U.S. Pat. No. 3,922,801 issued to Patrick Zente on Dec. 2, 1975;

U.S. Pat. No. 4,079,526 issued to Tatsuo Fukuoka on Mar. 21, 1978;

U.S. Pat. No. 4,709,921 issued to Valuikas et al. on Dec. 1, 1987;

U.S. Pat. No. 5,195,257 issued to Holcomb et al. on Mar. 23, 1993;

U.S. Pat. No. 4,094,081 issued to Reiner et al. on Jun. 13, 1978;

U.S. Pat. No. 4,095,353 issued to Foldes et al.;

U.S. Pat. No. 4,095,355 issued to Giuseppe Annovi on Jun. 20, 1978;

U.S. Pat. No. 3,859,727 issued to Hideru Nakamoto on Jan. 14, 1975;

1995 Teva—The Sport Sandal catalog;

Michele Turk, "$R_x$ for Sore Feet", *The Walking Magazine*, January/February 1996, pp. 30–34;

Terence P. Paré, "How To Invest In Fast-Growing Companies", *Fortune*, Apr. 17, 1995, p.105;

"High-Stepping Sandals", *Business Week*, May 8, 1995, p. 88;

"Voting With Their Feet", *Business Week*, May 22, 1995, p. 8;

"Smooth Loofah" article, (unknown publication and undated);

"Birko-Sport Insole" and "Noppy Insoles" advertisement sheet (unknown publication and undated);

"European Sport Sandals" advertisement (unknown publication and undated);

"What is the secret of Australia's massaging node sandals?" advertisement (unknown publication and undated);

"Arthritic Foot Management" "advertisement sheet (unknown publication and undated);

"Feel the walking pleasure of the islands.—Slip into soft, full-grain leather Hawaiian sandals." advertisement (unknown publication and undated);

"Your Feet—A Sensitive Issue" advertisement (unknown publication and undated);

"Class 5 Sport Sandals" catalog (undated);

"The Original Okabashi Shoes With Built-In Foot Therapy" advertisement (unknown publication and undated);

"Bio-Fit Custom Arch Supports" advertisement (unknown publication and undated);

"Athletes's Massaging Sandals" and "Gel Filled Insoles" advertisement sheet (unknown publication and undated);

"The Adventure Experts At Teva Innovate Again" advertisement (unknown publication and undated);

"We Had More Than Your Feet In Mind" Reebok advertisement (unknown publication and undated);

Birkenstock brochure (pages 1–4; undated);

Birkenstock Insoles brochure, pp. 1–7 (undated);

Birkenstock advertisement, 5 pages (undated);

"Our exclusive dual-chamber insoles give you deluxe massage and superb durability" advertisement (unknown publication and undated);

"Off The Road" Sports Sandals versus Sneakers, article, pg. 140 (unknown publication and undated).

Birkenstock advertisement, p. 97 (unknown publication and undated);

"Finn Comfort Shoes" advertisement (unknown publication and undated);

"Technical Sandals" Merrell Sport Sandals (unknown publication and undated);

Sensi Sandals, "The Sensi Story", 3 sheets (unknown publication and undated);

Teva Sandals—for "Barefoot" Comfort, 2 sheets (unknown publication and undated);

The teachings of each of the above-listed U.S. Patents (which does not itself incorporate essential material by reference) are herein incorporated by reference.

While the array of available footwear products has broadened, there still exists a need for further footwear products incorporating the use of natural materials therein.

SUMMARY OF THE INVENTION

This invention is directed toward satisfying the aforementioned need with respect to providing further footwear products in general, and with respect to providing further footwear products incorporating the use of natural materials therein in particular.

Accordingly, it is an object of the present invention to provide further footwear products incorporating the use of natural materials therein.

A second object of the present invention is to provide insole, liner, sandal, shoe and boot products incorporating the use of natural materials therein.

An even more particular object of the present invention is to provide insole, liner, sandal, shoe and boot products incorporating the use of natural loofah material therein.

A further particular object of the present invention is to utilize natural properties of loofah material to provide insole, liner, sandal, shoe and boot products having wearability and comfort advantages.

Also, a further particular object of the present invention is to utilize natural properties of loofah material to provide insole, liner, sandal, shoe and boot products having aesthetic advantages.

Still an even further particular object of the present invention is to utilize natural properties of loofah material to provide insole, liner, sandal, shoe and boot products having therapeutic advantages.

Applicant accomplishes the foregoing objects through the provision of a unique and novel combination invention, which in a broad sense, is directed to a footwear insert at least partially formed of loofah material. More particularly, the footwear insert can be in the form of an insole and is constructed such that loofah material thereof is arranged for direct contact with a user foot. Further, the insole can be totally formed of loofah material, or can be constructed of a first insole layer formed of loofah material and a second insole layer providing support for the loofah material. At least one of the insole or the first insole layer and the second insole layer has a varying thickness such that a surface of the footwear insert has depressions and ridges conforming to a non-planar shape (i.e., contour) of a bottom of a user foot. The insole is removably insertable into footwear. The first insole layer is integrated with said second insole layer through at least one of an adhesive, sewing, melting and molding process. Finally, the footwear insert can include both an insole at least partially formed of loofah material, and a liner at least partially formed of loofah material.

In an intermediate sense, Applicant's invention is directed to a footwear at least partially formed of loofah material. More particularly, the footwear is constructed such that loofah material thereof is arranged for direct contact with a user foot. Further, the insole can be at least partially formed of loofah material, wherein the footwear can be in the form of a sandal footwear having the insole formed of loofah material integrated therewith, or one of a shoe or boot footwear having said insole formed of loofah material integrated therewith. The insole can have a varying thickness such that a surface of the insole has depressions and ridges conforming to a non-planar shape of a bottom of a user foot. Alternatively, the insole can be constructed such that the insole comprises a first insole layer formed of loofah material, and a second insole layer providing support for the loofah material, wherein the first insole layer is integrated with the second insole layer through at least one of an adhesive, sewing, melting and molding process.

Finally, in a narrower sense, Applicant's invention is directed to a footwear in the form of one of a sandal or a shoe, the footwear comprising an insole layer at least partially formed of loofah material, and a sole providing support for said loofah material, wherein at least one of the insole layer and the sole has a varying thickness such that a surface of the insole layer has depressions and ridges conforming to a non-planar shape of a bottom of a user foot, and wherein the first insole layer is integrated with the sole through at least one of an adhesive bonding, electrostatic welding process and a molding process.

The foregoing and other objects, advantages, manner of operation, novel features and a better understanding of the present invention will become apparent from the following detailed description of the preferred embodiments and claims when read in connection with the accompanying drawings, all forming a part of the disclosure of this invention. While the foregoing and following written and illustrated disclosure focuses on disclosing embodiments of the invention which are considered preferred embodiments at the time the patent application was filed in order to teach one skilled in the art to make and use the invention, and to otherwise satisfy the best mode disclosure requirements under U.S. patent law, it should be clearly understood that the same is by way of illustration and example only and is not to be taken by way of limitation, the spirit and scope of the present invention being limited only by the terms of the appended claims.

BRIEF DESCRIPTION OF THE DRAWINGS

The following represents brief descriptions of the drawings, wherein.

DETAILED DESCRIPTION OF THE PREFERRED EMBODIMENTS OF THE INVENTION

Figure 1A:
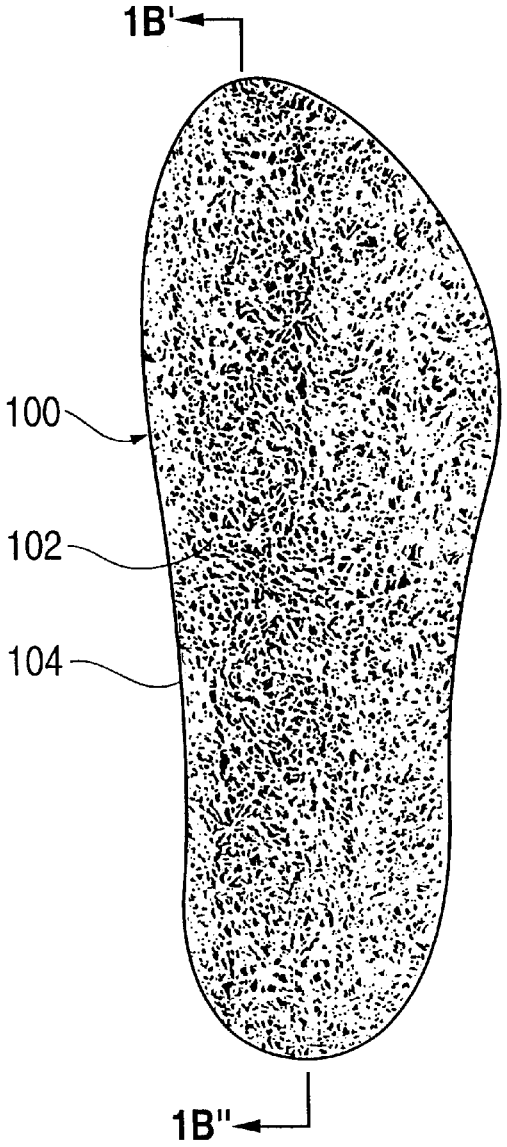
FIG. 1A is a top view and FIG. 1B is a side view (taken along line 1B'-1B" of FIG. 1A) of a first preferred, flat insole combination arrangement of the present invention.

Before beginning a detailed description of the subject invention, mention of the following is in order:

When appropriate, like reference numerals and characters are used to designate identical, corresponding or similar components in differing figure drawings. Further, reference numerals and characters which are offset by multiples of 100

(e.g., 210, 510, 910, etc.) are sometimes used to designate identical, corresponding or similar components in differing figure drawings or construction locations.

The figure drawings associated with this disclosure typically are not drawn with dimensional accuracy or to scale, i.e., such drawings have been drafted with a focus on clarity of viewing and understanding rather than dimensional accuracy. An attempt has been made specifically to point out any dimensions, tolerances, etc. which are important.

Within the following discussions, terms of relative directions (e.g., top, bottom, left, right) are used. All such terms of relative directions are meant to be interpreted with respect to placements of insoles, liners and footwear in a normal operative position with respect to a user foot, for example, with a sole representing a "bottom" or "lower" direction; an insole or uppers of the footwear representing a "top" or "upper" direction; and "right" and "left" being defined with respect to a user's right and left while the insoles, liners and footwear are worn in a normal operative position with respect to a user foot.

Further, before turning to a description of preferred embodiments of the invention, discussion of the following background is in order. The disclosed and claimed invention is generally directed toward increased use of natural material in consumer products, and is more particularly directed to the use of natural material within footwear products. In this regard, the disclosed and claimed invention incorporates natural loofah (sometimes written "luffa" or "loofa") material within consumer footwear products. Loofah material (usually in the form of a loofah "sponge") is actually the fibrous, dried inside of a vegetable (e.g., *Lufia aegyptiaca*), which is a cucumberlike gourd which grows on a vine in Florida and in other warm and hot regions of the world. Manufacturing benefits of loofah material are that loofah is a relatively cheap natural material, is readily plentiful and is easily machinable (e.g., cut, sewn, stamped). Wearability benefits of loofah material are that loofah is durable and the loofah's mesh-like structure provides a desirable non-slip surface. Therapeutic benefits of loofah material are that the loofah's interwoven, string-like fibers provide a slight massaging effect, slight exfoliation of the skin, and increased blood flow (due to massaging). Wearability benefits of loofah material are that the loofah's interwoven, mesh-like structure represents an arrangement which allows excellent ventilation of skin in contact therewith. Aesthetic benefits of loofah material are that the loofah's natural tan color is pleasing, or alternatively, loofah can be dyed to any other desired color. Additional benefits of loofah material with respect to footwear products will be further mentioned whenever appropriate in the discussions to follow.

Figure 1B:
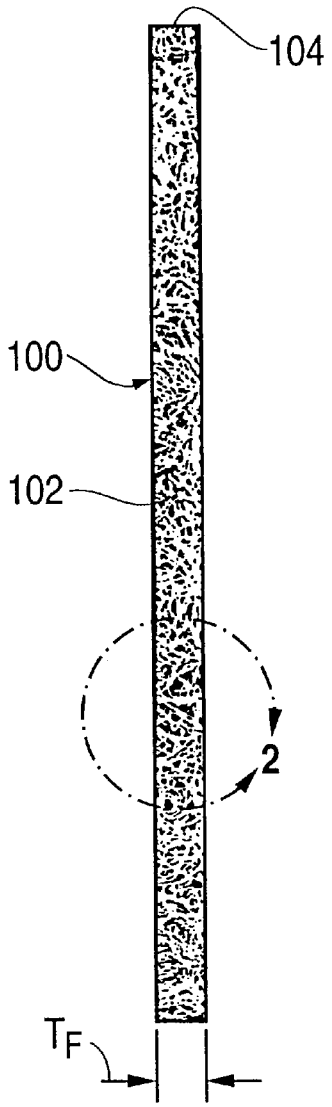

Turning now to a detailed description of a preferred embodiment of the invention, FIG. 1A is a top view and FIG. 1B is a side view (taken along line 1B'–1B" of FIG. 1A) of a first preferred combination arrangement of the present invention. More particularly, there is illustrated a flat insole 100 substantially made of loofah material 102. In preferred methods of manufacturing such first preferred embodiment, the insoles are actually stamped out with a "cookie cutter" type process (e.g., via a die and press arrangement) or cut (e.g., via a blade, scissors or laser) from a substantially flat sheet of loofah material, although in practice the method of manufacture is not limited to such method. In a preferred embodiment, the thickness $T_F$ of the flat insole 100 should be in the range of 2/16" to ½" and more preferably 3/16" to ¼" in order to afford sufficient cushioning and durability, although in practice the thickness is not limited to the same. Although in a preferred embodiment, the insole edges 104 are not finished, such insole edges 104 can instead be finished, with non-exhaustive finishing examples including sewing, edge dipping (e.g., in a plastic or rubber material) and taping. Similarly, the bottom of the flat insole 100 can be untreated and thus rely solely on the non-slip qualities of the loofah material 102 to positionally maintain the flat insole 100 with respect to the footwear wherein it is installed, or alternatively, the bottom can incorporate an enhanced non-slip treatment to enhance positional maintenance (e.g., an adhesive region protected by non-adhesive protective strip which is removed by user immediately before installation in a footwear).

An important arrangement to note with respect to the present invention, is that the loofah material used within the above- and below-described embodiments is always arranged so as to provide direct contact with a user foot. Direct contact between the user foot and the loofah material is advantageous and desirable for a number of reasons. More particularly, as mentioned above, therapeutic and wearability benefits of loofah material are that the loofah's interwoven, string-like fibers provide a slight massaging effect, exfoliation of the skin, increased blood flow to the massaged skin region and excellent ventilation with respect to a contacting user foot. In terms of wearability with respect to a contacting user foot, the loofah's mesh-like structure provides a desirable non-slip surface. Further wearability benefits will be explained with respect to FIG. 2.

Figure 2:
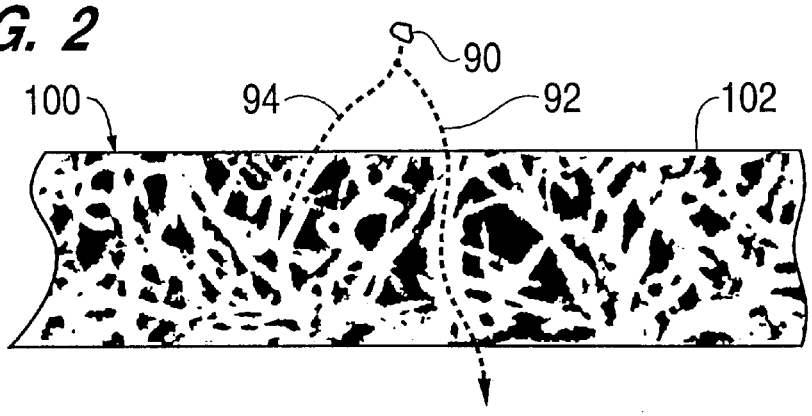
FIG. 2 represents an enlarged cut-away view of the loofah material 102 of the flat insole 100 within a region 2 in FIG. 1B.

More particularly, FIG. 2 represents an enlarged cut-away view of the loofah material 102 of the flat insole 100 within a region 2 in FIG. 1B. Further shown is a foreign object 90 (e.g., a sand pebble, or water), which in the terms of typical insoles, liners and footwear, would represent an uncomfortable irritant when sandwiched between a user foot and the typical insoles, liners and/or footwear. Further wearability benefits are gained by the present invention in that vacant channels or chambers within loofah's mesh-like structure provide a convenient arrangement for evacuation of foreign objects 90 from direct contact with a user foot. More particularly, as illustrated in FIG. 2, the foreign object 90 is allowed by the loofah's mesh-like structure to move out of direct contact with a user foot by entering the loofah's accommodating channels or chambers, for example, to travel along an evacuation path 92 resulting in the foreign object 90 being totally evacuated from the insole, liner or footwear, or to travel along an evacuation path 94 resulting in the foreign object 90 being contained within the loofah material. In either event, a wearability of the insole, liner or footwear is enhanced in that irritants are quickly removed from direct contact with a user foot.

In order to minimize the number of sizes in which the flat insole 100 is commercially provided, the flat insole 100 can be generically provided in a single over-sized form to accommodate installation in footwear of a predetermined maximum footwear size (e.g., a men's size 14 footwear), and can be further accompanied by a template (e.g., printed thereon or separate therefrom; not shown) indicative of the outlines of various smaller footwear sizes to allow an ultimate user to customize the size of the flat insole 100 via a sharp blade or scissors. Further, while the FIGS. 1A and 1B insole embodiment is illustrated as providing an insole which accommodates the entire bottom area of a user foot, the present invention is not limited to the same, e.g., there can be constructed a partial insole which accommodates a portion of a user's foot, e.g., only the heel and arch area.

As further advantageous arrangements, the loofah material used within the above- and below-described embodiments can be provided with supplemental desirable treatments, i.e., non-limiting examples including application of a perfume, deodorant, anti-fungal agent, and/or anti-mold agent. Further, the color of the loofah material can be customized with well-known color treatment methods, with non-limiting examples including dyeing and painting. As a final note, the flat insole 100 can be provided as a multi-layered construction such as that discussed ahead with respect to the FIG. 3B, FIG. 4 and FIG. 9 embodiments.

Figure 3B:
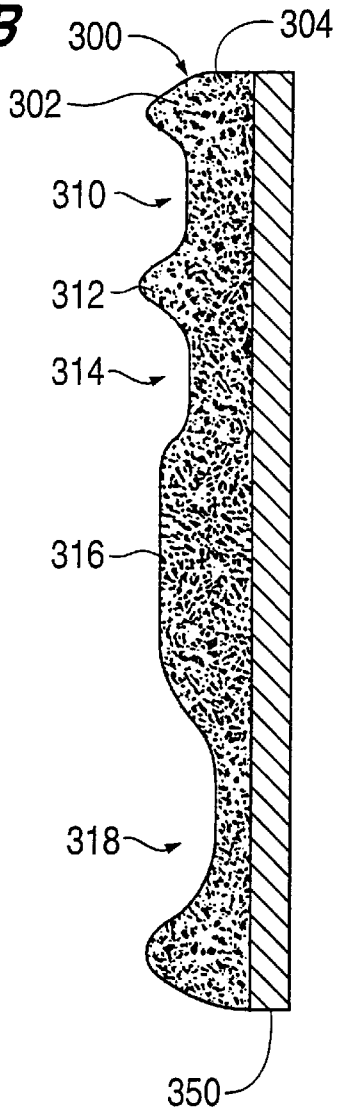
FIG. 3A is a top view and FIG. 3B is a side view (taken along line 3B'–3B" of FIG. 3A) of a second preferred, contoured insole combination arrangement of the present invention.
Figure 3A:
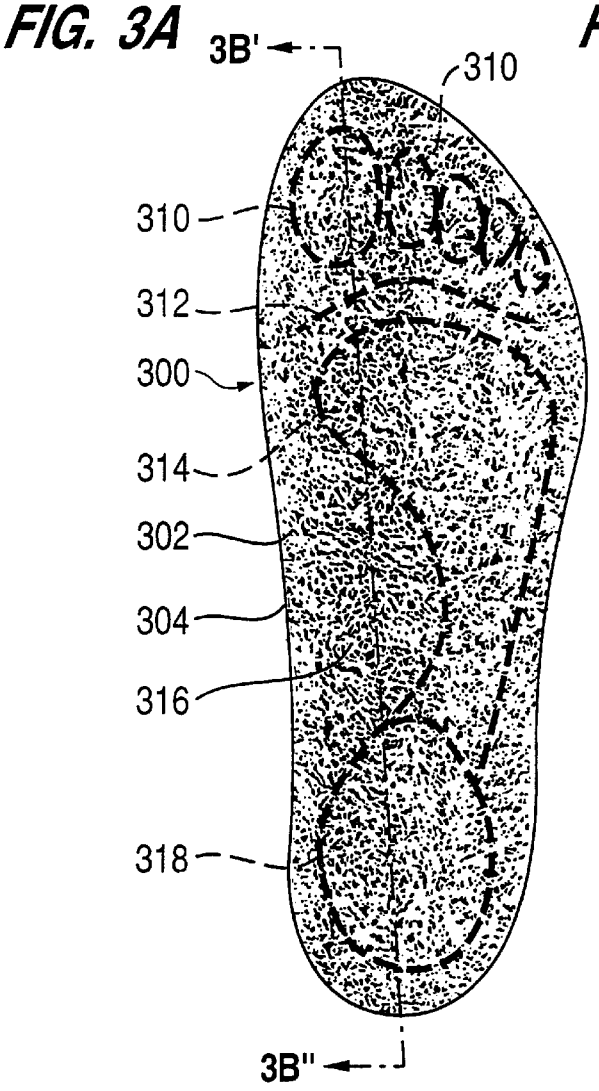

Turning now to a further detailed description of another embodiment, FIG. 3A is a top view and FIG. 3B is a side view (taken along line 3B'–3B" of FIG. 3A) of a second preferred combination arrangement of the present invention. More particularly, there is illustrated a contoured insole 300 substantially made of loofah material 302. The contoured insole 300 is illustrated as including toe cups (i.e., indentations) 310, a toe bar (i.e., raised ridge) 312, a foot cup (i.e., indentation) 314, an arch support (i.e., raised incline or plateau) 316, and a heel cup (i.e., indentation) 318. The toe cups 310, toe bar 312, foot cup 314, arch support 316, and heel cup 318 are for the purpose of more exactly conforming to an irregular shape of a user foot, to thereby afford greater degrees of support and comfort over those afforded by the above-described flat insole 100.

In preferred methods of manufacturing such preferred embodiment, the insoles are actually stamped out with a "cookie cutter" type process (e.g., via a die and press arrangement) or cut (e.g., via a blade, scissors or laser) from a sheet of loofah material, although in practice the method of manufacture is not limited to such methods. The shape and contours of the toe cups 310, toe bar 312, foot cup 314, arch support 316, and heel cup 318 of the insole can be formed by drying the gourds on a template (e.g., die and press) which mirrors the design of an anatomically correct instep. In one embodiment as illustrated in FIG. 3B, the layer of loofah material 302 is of varying thicknesses to accomplish the shape and contours of the toe cups 310, toe bar 312, foot cup 314, arch support 316, and heel cup 318 of the contoured insole 300, and is integrated (e.g., via an adhesive, sewing, melting or molding process) with an insole support 350. The insole support can be made of any well-known footwear material, e.g., leather-like, suede-like, wood-like, cork-like, plastic-like and/or rubber-like materials (e.g., rubber, PVC, polyurethane, silicon).

Figure 4:
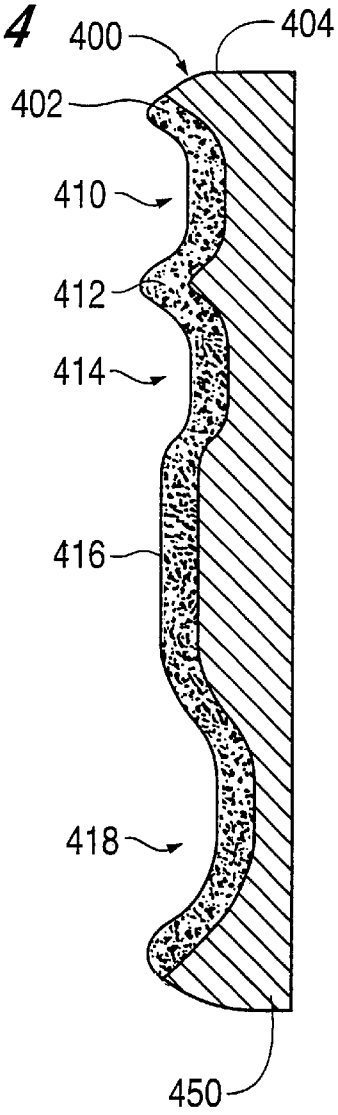
FIG. 4 is an alternative construction arrangement with respect to the embodiment illustrated in FIG. 3B.

In an alternative embodiment as illustrated in FIG. 4, a layer of loofah material 402 is of a substantially constant thickness, and is integrated (e.g., via an adhesive, sewing, melting or molding process) with an insole support 450 of varying thicknesses to accomplish the shape and contours of toe cups 410, toe bar 412, foot cup 414, arch support 416, and heel cup 418 of a contoured insole 400.

In a preferred embodiment, the thickness $T_C$ of the contoured insole 300/400 should be in the range of 2/16" to ½", and more preferably 3/16" to ¼" in order to afford sufficient cushioning and durability, although in practice the thickness is not limited to the same. Although in a preferred embodiment, the insole edges 304/404 are not finished, such insole edges 304/404 can instead be finished, with non-exhaustive finishing examples including sewing, edge dipping (e.g., in a plastic or rubber material) and taping. Further, the bottom of the contoured insole 300/400 (i.e., the bottom of the insole support 350/450 can incorporate an enhanced non-slip treatment to enhance positional maintenance within the footwear (e.g., an adhesive region protected by non-adhesive protective strip which is removed by the user immediately before installation the in the footwear).

Again, an important arrangement to note with respect to the present embodiment (like the previously discussed embodiment), is that the loofah material is always arranged so as to provide direct contact with a user foot. As stated previously, direct contact between the user foot and the loofah material is advantageous and desirable in order to avail to the user's foot the therapeutic benefits of massaging, exfoliation of the skin, increased blood flow, and ventilation, and the wearability benefits of a non-slip surface and evacuation of foreign objects 90 from direct contact with a user foot.

Again, in order to minimize the number of sizes of which the contoured insole 300/400 is commercially provided, the contoured insole 300/400 can be generically provided in a single over-sized form to accommodate installation in footwear of a predetermined maximum footwear size (e.g., a men's size 14 footwear), and can be further accompanied by a template (e.g., printed thereon or separate therefrom; not shown) indicative of the outlines of various smaller footwear sizes to allow an ultimate user to customize the size of the contoured insole 300/400 template via a sharp blade or scissors. However, in view of the fact that different foot sizes are subject to different sized contour patterns, provision of the contoured insoles 300/400 in a single generic size is less desirable (than the flat insole 100) in that conformity of the contoured insoles 300/400 will be less than perfect with varying foot sizes, and accordingly, in a preferred embodiment it is desirable that separate contoured insoles 300/400 exactly matching each foot size be provided. Further, while the FIGS. 3A–3B and 4 contoured insole embodiments are illustrated as providing an insole which accommodates the entire bottom area of a user foot, the present invention is not limited to the same, e.g., there can be constructed a partial insole which accommodates only a portion of a user's foot, e.g., the heel and arch area.

As further advantageous arrangements, the loofah material used within the above- and below-described embodiments can be provided with supplemental desirable treatments, i.e., non-limiting examples including application of a perfume, deodorant, anti-fungal agent, and/or anti-mold agent. Such supplemental treatments can be incorporated within the loofah material itself, or may instead be incorporated within the insole support 350/450. Further, the color of the loofah material can be customized with well-known color treatment methods, with non-limiting examples including dyeing and painting.

Figure 5:
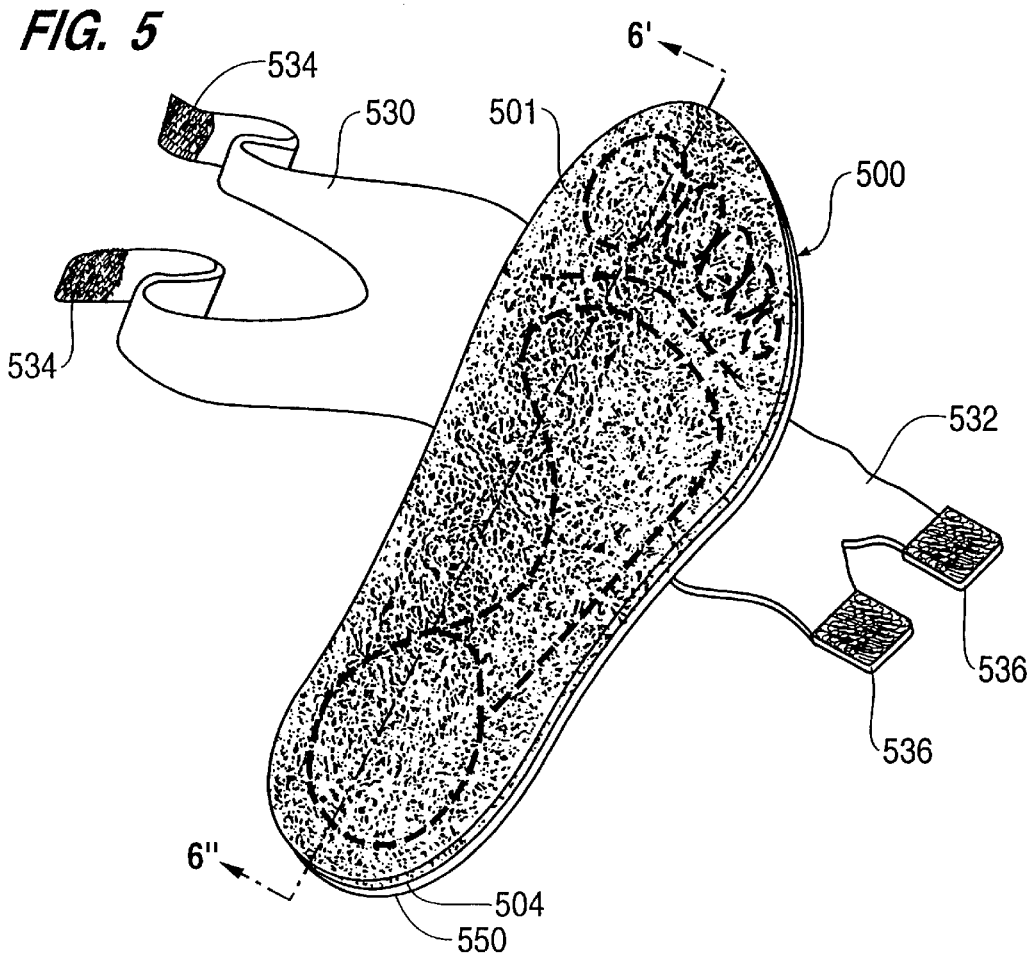
FIG. 5 is a perspective view and FIG. 6 is a side view (taken along line 6'–6" of FIG. 5) of a third preferred, loofah loafer combination arrangement of the present invention.
Figure 6:
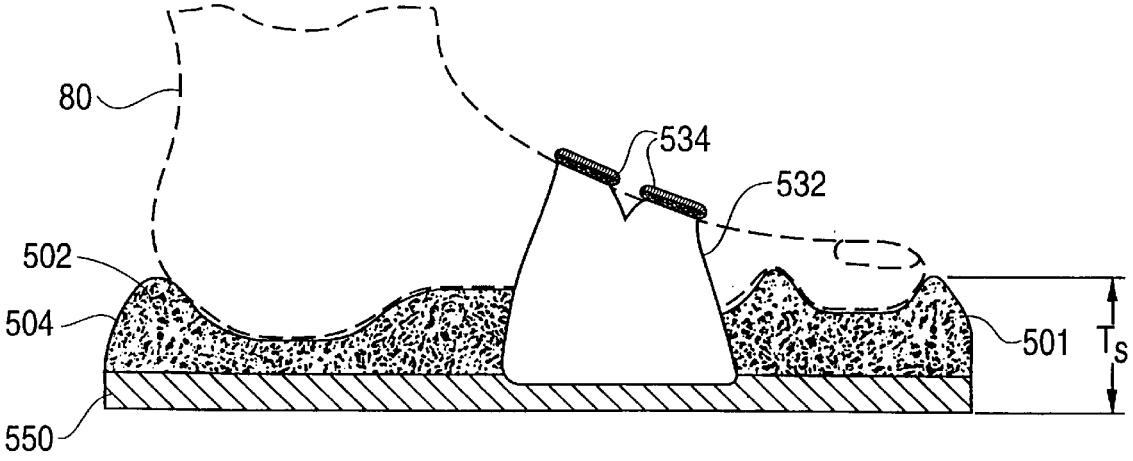

Turning now to a further detailed description of another embodiment, FIG. 5 is a perspective view and FIG. 6 is a side view (taken along line 6'–6" of FIG. 5) of a third preferred combination arrangement of the present invention. More particularly, there is illustrated a loofah sandal 500 incorporating a contoured insole 501 substantially made of loofah material 502. The contoured insole 501 is illustrated as including toe cups (i.e., indentations), a toe bar (i.e., raised ridge), a foot cup (i.e., indentation), an arch support (i.e., raised incline or plateau), and a heel cup (i.e., indentation). The toe cups, toe bar, foot cup, arch support and heel cup are for the purpose of more exactly conforming to an irregular shape of a user foot to thereby afford greater degrees of support and comfort over those afforded by the above-described flat insole 100. While the third preferred sandal embodiment is illustrated as incorporating a contoured insole 501, the present invention is not limited thereto, e.g., the sandal embodiment 500 may instead include a flat insole 100 such as that illustrated with respect to FIGS. 1A–1B.

Preferred manufacturing methods of the contoured insole 501 are the same as those set forth with respect to the above-described contoured insoles 300/400, i.e., the insoles can be stamped out with a "cookie cutter" type process (e.g., via a die and press arrangement) or cut (e.g., via a blade, scissors or laser) from a sheet of loofah material, and the shape and contours of the toe cups, toe bar, foot cup, arch support and heel cup of the insole can be formed by drying the loofah material on a template (e.g., die and press) which mirrors the design of an anatomically correct instep. Further, while the FIG. 6 illustrated embodiment shows an arrangement wherein the layer of loofah material 502 is of varying thicknesses to accomplish the shape and contours of the toe cups, toe bar, foot cup, arch support and heel cup of the contoured insole 501 (similarly to that of FIG. 3B), the sandal embodiment 500 can instead be provided in an alternative arrangement such as that illustrated in FIG. 4, wherein the layer of loofah material 502 is of a substantially constant thickness, and is integrated with an insole support 550 of varying thicknesses to accomplish the shape and contours of the toe cups, toe bar, foot cup, arch support and heel cup. In either embodiment, the contoured insole 501 is integrated with insole support 550 via any of the well known integration methods, e.g., via an adhesive, sewing, melting or molding process.

The sandal embodiment 500 further includes sandal straps 532/530 which are arranged to wrap around a user foot (as illustrated in FIG. 6) and to be fastened to one another via sandal fasteners 534/536. While in a preferred embodiment, the sandal straps 530/532 are formed of a cloth-like, suede-like, leather-like, plastic-like or rubber-like material (e.g., suede, leather, nylon), the present invention is not limited thereto, and any well known footwear material can be substituted therefor. While in a preferred embodiment, the sandal fasteners 534/536 are provided by a mating Velcro® arrangement, the present invention is not limited thereto, i.e., the sandal fasteners 534/536 can instead be provided through any of numerous well known fastening methods including a belt/buckle arrangement, a snapping arrangement, a shoe lace arrangement, etc.

In a preferred embodiment, the thickness $T_S$ of the sandal embodiment 500 should be in the range of 2/16" to ½", and more preferably 3/16" to ¼" in order to afford sufficient cushioning and durability, although in practice the thickness is not limited to the same. The further discussions discussed above with regard to the flat and contoured insoles apply equally as well to the sandal embodiment 500, i.e., the insole edges 504 can be finished, the loofah material is arranged so as to provide direct contact with a user foot in order to avail the user foot of the therapeutic benefits and wearability benefits of loofah.

As a further advantageous arrangement, in order to accommodate the varying lives of the arrangement of the insole support 550, the sandal straps 530/532 and sandal fasteners 534/536 verses the life of the contoured insole 501, the contoured insole 501 can be provided so as to be removably replaceable with respect to the sandal embodiment 500, e.g., the contoured insole 501 can be removably retained with respect to the insole support 550 via a Velcro® fastening arrangement, an adhesive layer, etc. Alternatively, the contoured insole 501 can be permanently affixed to the insole support 550 such that the sandal embodiment is disposable whenever one or the other of the contoured insole 501 or insole support 550, sandal straps 530/532 and sandal fasteners 534/536 wear out.

As a further arrangement, loofah material can be incorporated onto the foot contacting surfaces of the sandal straps 530/532 in order to increase the area of loofah material exposure to the user foot, again to avail to the user foot the therapeutic and wearability of loofah. Further, the present invention is not limited to the sandal strap arrangement illustrated in FIGS. 5 and 6, i.e., the sandal straps can be provided through any other well known sandal strap arrangement, including the provision of an additional heel strap.

In order to afford a reasonable degree of durability, the insole support 550 (which contacts a walking surface) is preferably made of a suede-like, leather-like, plastic-like or rubber-like material (e.g., rubber, polyurethane, PVC, silicone). However, in practice, the insole support 550 is not limited to such materials, and any other well known footwear materials can be substituted therefor.

In view of the fact that different foot sizes are subject to different sized contoured patterns, provision of the sandal embodiment 500 in a single generic customizable size is not desirable in that conformity of the sandal embodiment and contoured insole 501 therein with a user foot will be less than perfect, and the sandal embodiment 500 will typically be of a sufficient thickness such as to make it difficult for a typical consumer to cut the same, and further, cutting thereof may effect the integrity, appearance and safety of the sandal embodiment 500. Accordingly, in a preferred embodiment, it is desirable that separately sized sandal embodiments 500 exactly matching various foot sizes should be provided. However, in order to minimize the number of sizes in which the sandal embodiment 500 is commercially provided, the sandal embodiment can be generically provided in a smaller number of sizes (e.g., "small", "medium" and "large"), i.e., with each provided size accommodating several predetermined footwear sizes (e.g., a "medium" size accommodating a women's size 7 or 8 footwear).

Like the previously discussed insole embodiments, the sandal embodiment can be provided with supplemental desirable treatments, i.e., non-limiting examples including application of a perfume, deodorant, anti-fungal agent, and/or anti-mold agent. Such supplemental treatments can be incorporated within the loofah material itself, or may instead be incorporated within any of the insole support 550, the sandal straps 530/532 and/or the sandal fasteners 534/536. Further, the color of the loofah material can be customized with well-known color treatment methods, with non-limiting examples including dying and painting.

Figure 7:
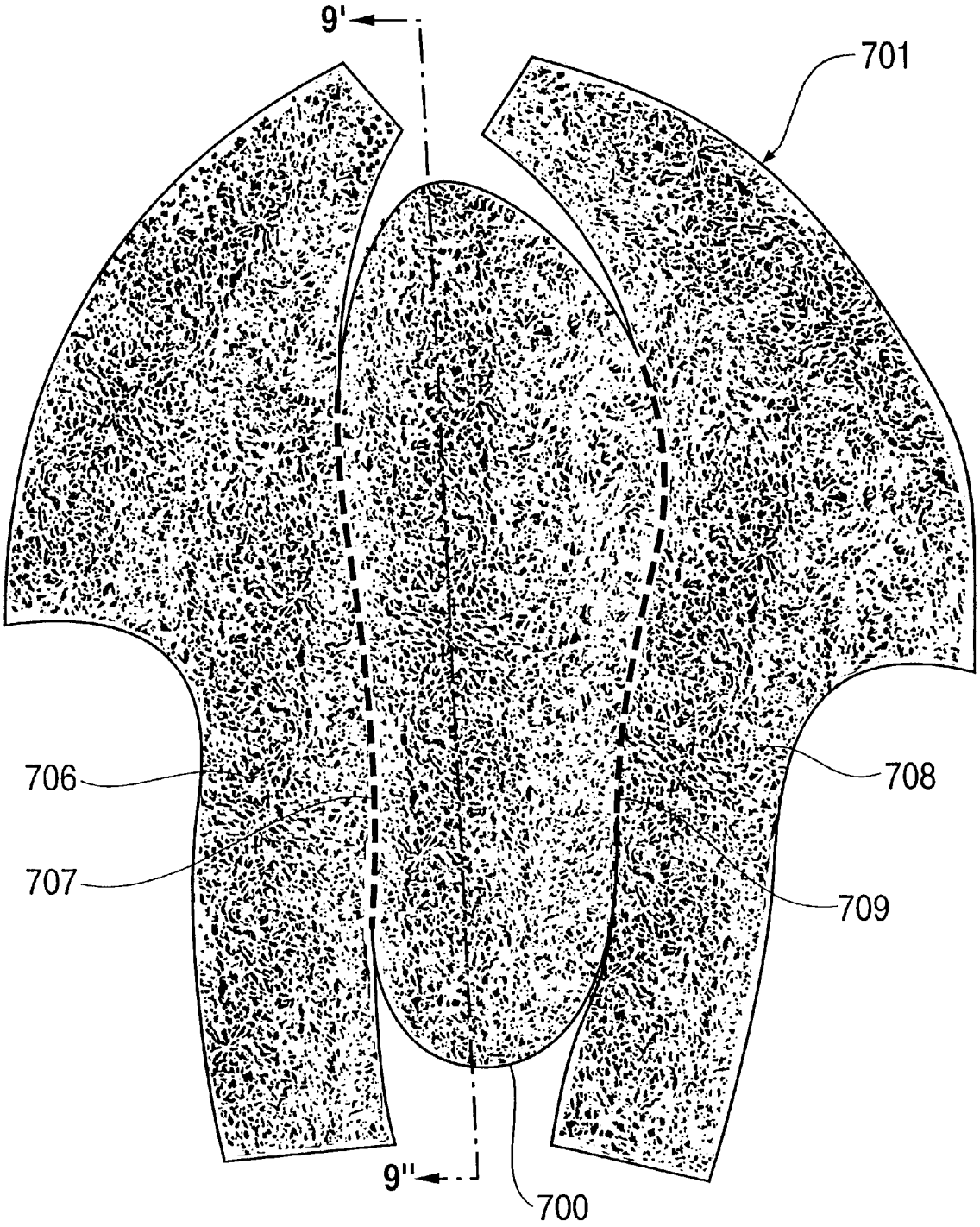
FIG. 7 illustrates a preferred loofah liner embodiment of the present invention in unassembled form.
Figure 8:
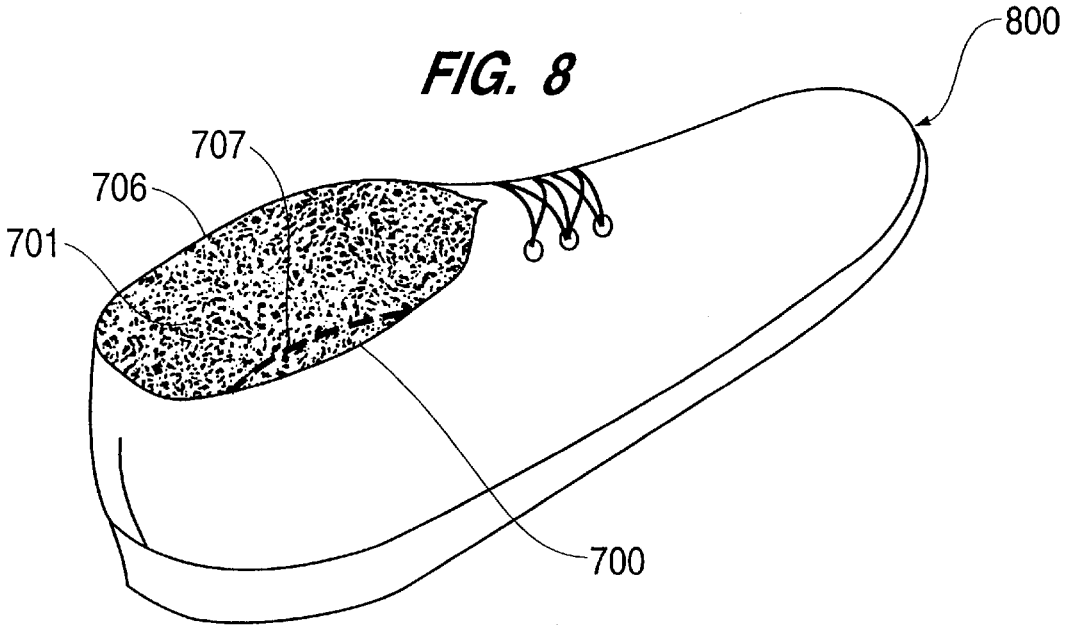
FIG. 8 illustrates a perspective view of a footwear product incorporating the loofah liner of FIG. 7.
Figure 9:
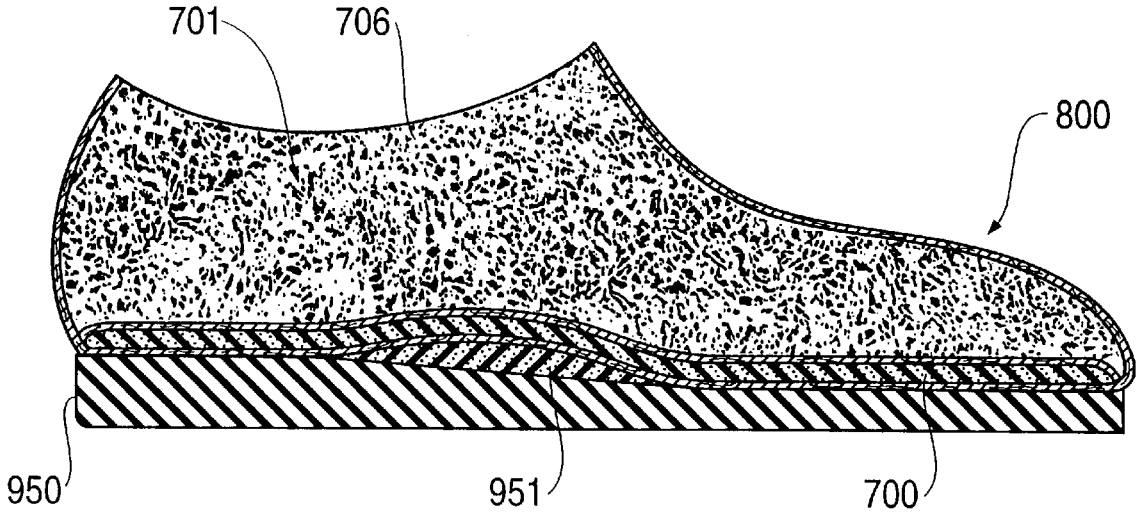
FIG. 9 is a cross-sectional view of a footwear product incorporating the loofah liner of FIG. 7, with a cross-section being taken along a line 9'–9" shown in FIG. 7.

Turning now to a final preferred embodiment of the invention, a loofah liner 701 is illustrated in an unassembled form in FIG. 7, and in assembled form within the perspective view of the footwear of FIG. 8 and the cross-sectional view of FIG. 9. More particularly, in FIG. 7, there is shown a loofah liner 701 which is meant for incorporation within a shoe-like footwear as illustrated in FIGS. 8 and 9. The loofah liner 701 includes an insole 700 and loofah uppers 706/708. In a preferred manufacturing method of the loofah liner 701, such liner is stamped out with a "cookie cutter" type processes (e.g., via a die and press arrangement) or cut (e.g. via a blade, scissors or laser) from a sheet of loofah material, although in practice, manufacture is not limited to such methods. Further, while in the illustrated preferred embodiment, the insole 700 and the loofah uppers 706/708 are shown as being cut from a single sheet of loofah material and folded along fold lines 707 and 709 during assembly, the insole 700 and loofah uppers 706/708 can instead be provided as separately manufactured parts. In fact each of the insole 700 and loofah uppers 706/708 may themselves be provided by a plurality of parts which are suitably integrated during assembly of the loofah liner 701 through any well known bonding methods including use of adhesive materials, sewing, or attachment to a backing material.

As in the previous embodiments, the loofah material of the loofah liner is arranged so as to provide direct contact with a user foot. Again, such direct contact with the user foot is for the purpose of availing to a user foot the therapeutic and wearability benefits of loofah material.

The loofah liner 701 can be provided as a removable insert which can be removably insertable into a desired footwear in order to afford a loofah lining thereto, or alternatively, the loofah liner can be provided as a permanent lining to a footwear product. When provided as a removable insertable insert, the thickness of the loofah uppers 706/708, and further, the thickness of the loofah insole 700 should be sufficiently thin to afford the benefits of loofah material while not crowding the user foot within the modified footwear 800. Incorporation of the loofah liner 700 as the permanent layer within a footwear has likewise concerns, although any need for adjustment in a sizing of the footwear to provide proper sizing while including the loofah liner 701 can be compensated for during manufacturing design.

The loofah insole 700 portion of the loofah liner can be provided as a flat insole (as discussed with respect to FIGS. 1A–1B) or alternatively, can be provided as a contoured insole (as discussed with respect to FIGS. 3A–3B, and FIG. 4). Further, as illustrated with respect to FIG. 9, the present invention is not limited to an arrangement wherein an insole arrangement is only provided with the two layers of a loofah insole and insole support; i.e., as illustrated in FIG. 9, an intermediate insole or insole portion 951 can be incorporated or sandwiched between the loofah insole 700 and insole support 950. Further, Applicant's invention is not limited to a three-layer insole structure, but instead may include any number of insole layers. As a final note, while Applicant's loofah liner 701 is illustrated as providing loofah material along an entirety of a footwear cavity, Applicant's invention is not limited thereto, and instead, Applicant's invention can be arranged to provide loofah material only along desired portions of the footwear cavity.

This concludes the description of the preferred embodiments.

Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject loofah combination arrangements within the scope of the foregoing disclosure, the drawings and the appended claims without departing from the spirit of the invention, e.g., the following represents a non-exhaustive list of modifications which might readily be apparent to one skilled in the art to which the present invention is directed: the loofah material may not be provided as part of an integral natural loofah sheet formed from a single loofah gourd, but may instead be formed of separate loofah fibers bonded to each other or to a backing material.

In addition to variations and modifications in the component parts and/or arrangements, uses with alternative footwear materials in conjunction with the loofah material and alternative footwear designs will also be apparent to those skilled in the art. More particularly, while the above disclosure has discussed applications of the subject loofah combination arrangements with respect to, e.g., a human user foot, it will be apparent to those skilled in the art that each of the subject loofah combination arrangements are not so limited to such usage, but instead, could find application in a tremendous number of other non-human foot uses, e.g., the loofah combination arrangements disclosed above might have application with respect to various animal feet. In addition, other natural materials comparable to loofah may be suitable for total or partial substitution for the loofah in the above embodiment, e.g., sisal.

What is claimed and desired to be secured by Letters Patent of the United States is:

1. A footwear insert comprising an insole formed at least partially of sisal material and having stitching through the sisal material to define areas for contouring of the sisal material to give the insole a varying thickness, with an upper surface having depressions and ridges to accommodate the bottom of a user foot, the depressions and ridges providing increased massaging of the user foot.

2. A footwear insert as claimed in claim 1, wherein said sisal material is arranged for direct contact with the user foot.

3. A footwear insert as claimed in claim 1, wherein said insole is totally formed of sisal material.

4. A footwear insert as claimed in claim 1, wherein said insole is removably insertable into footwear.

5. A footwear insert as claimed in claim 1, wherein said insole comprises:

a first insole layer formed of sisal material and having said upper surface thereon; and a second insole layer providing support for said first insole layer sisal material and having a substantially planar lower surface.

6. A footwear insert as claimed in claim 5, wherein at least one of said first insole layer and said second insole layer has a varying thickness.

7. A footwear insert as claimed in claim 5, wherein said first insole layer is integrated with said second insole layer through at least one of an adhesive, sewing, a melting process, and a molding process.

8. A footwear insert as claimed in claim 1, wherein said footwear insert further comprises a liner at least partially formed of sisal material and adhered to said contoured insole.

9. A footwear insert as claimed in claim 1, wherein the depressions and ridges provide toe caps, a toe bar, a foot cap, an arch support and a heel cup.

10. A footwear comprising an insole formed at least partially of sisal material and having an upper surface and a lower surface, with stitching through the sisal material to define areas for contouring of the sisal material to provide depressions and ridges on said upper surface to accommodate the bottom of a user foot; and an insole support adhered to said insole lower surface, the depressions and ridges providing increased messaging of the user foot.

11. A footwear as claimed in claim 10, wherein said sisal material is arranged for direct contact with the user foot.

12. A footwear as claimed in claim 10, wherein said footwear comprises a sandal.

13. A footwear as claimed in claim 10, wherein said footwear comprises a shoe.

14. A footwear as claimed in claim 13, wherein said insole comprises:

a first insole layer formed of sisal material having said upper surface thereon; and a second insole layer providing support for said sisal material and having said lower surface thereon.

15. A footwear as claimed in claim 14, wherein said first insole layer is integrated with said second insole layer through at least one of an adhesive, sewing, a melting process and a molding process.

16. A footwear as claimed in claim 10, wherein said footwear comprises a boot.

17. A footwear as claimed in claim 10, wherein said contoured insole is totally formed of sisal material.

18. A footwear as claimed in claim 10, wherein at least one of said insole and said insole support has a varying thickness.

19. A footwear as claimed in claim 10, wherein said insole support is removable adhered to said insole lower surface.

20. A footwear as claimed in claim 10, wherein the depressions and ridges provide toe caps, a toe bar, a foot cap, an arch support and a heel cup.

* * * * *